United States Patent [19]

Wessman et al.

[11] Patent Number: 4,766,942

[45] Date of Patent: Aug. 30, 1988

[54] EVAPORATIVE PATTERN ASSEMBLY AND METHOD OF MAKING

[75] Inventors: Eric J. Wessman, Plymouth; Charles R. Dysarz, Dearborn, both of Mich.

[73] Assignee: Ford Motor Company, Dearborn, Mich.

[21] Appl. No.: 133,822

[22] Filed: Dec. 16, 1987

[51] Int. Cl.[4] ..... B22C 9/04

[52] U.S. Cl. ..... 164/34; 164/45; 164/246

[58] Field of Search ..... 164/45, 34, 35, 36, 164/246

[56] References Cited

U.S. PATENT DOCUMENTS

| | | |
|---|---|---|
| 4,003,424 | 1/1977 | Hetke et al. . |
| 4,061,175 | 12/1977 | Watts . |
| 4,064,927 | 12/1977 | Ostrowski . |
| 4,109,699 | 8/1978 | Miller et al. . |

FOREIGN PATENT DOCUMENTS

| | | | |
|---|---|---|---|
| 3136004 | 6/1982 | Fed. Rep. of Germany | 164/35 |
| 60-49832 | 3/1985 | Japan | 164/35 |

*Primary Examiner*—Kuang Y. Lin

*Attorney, Agent, or Firm*—Joseph W. Malleck; Roger L. May

[57] ABSTRACT

An apparatus is disclosed for an evaporative pattern assembly for metal castings and associated cast metal feeding, the assembly comprising: (a) a central upright sprue; (b) a plurality of sprue branches integral with and extending radially away from said central sprue at each of at least two axial locations of the central sprue; (c) at least two gating rails, each integrally connected with the extremities of at least two sprue branches extending from different axial locations of the central sprue, each rail being connected to different and independent sprue branches so as to be supported in circumferentially-spaced positions relative to each other about said sprue; and (d) at least one pattern body integrally connected across two of said gating rails. Preferably, the body is complex in configuration having a plurality of projections connected to said rails by gates. The radially extending sprue branches are advantageously layered in different planes with the angular spacing between branches being in the range of 45°–90°. Also disclosed is a method of making and a method of using such evaporative pattern assembly.

10 Claims, 3 Drawing Sheets

2
2
11
12
13
13a
13b
13c
13d
13e
13f
14
15
16
17
20
22
23
24
25
26
27
29
30
31
32
33
40
10

EVAPORATIVE PATTERN ASSEMBLY AND METHOD OF MAKING

BACKGROUND OF THE INVENTION

1. Technical Field

This invention relates to the evaporative casting process (ECP) employing a mold within which is embedded a relatively low density pattern material that is destroyed and evaporated upon contact with molten metal poured into the mold. More particularly, this invention relates to the art of designing and making such patterns for improved accuracy of dimensions in the making of metal castings.

2. Description of the Prior Art

ECP employs a heat consummable pattern and associated cast metal feeding members (hereinafter low density system) that are all commonly made of the same material. The material is preferably low density foam expanded bead polystyrene. Upon contact with molten metal poured into the mold containing such low density system, the material is ignited, burned and evaporated, and the gases therefrom migrate outwardly through the interstices of unbonded sand forming the mold.

In the process of settling dry, unbonded sand about such low density system, the patterns may become slightly misaligned or distorted by the sand filling forces. It has become common practice to attach several of such patterns to a central, consummable, upright sprue by way of radiating horizontal runners (see U.S. Pat. No. 4,003,424). Complex patterns which have one or more projections from such pattern are subject to distortion by the filling forces of such sand as the sand advances along an angle of repose during the filling operation. The projections of such patterns, as well as the pattern itself, are frequently cantilevered structures, that is, they are hung at the end of a horizontally extending member.

Although no prior art has been found which addresses itself to the problem mentioned above, within the art of ECP, an examination of the lost wax method of casting discloses that multiple patterns have been hung on trees along with a gating system (see U.S. Pat. Nos. 4,109,699; 4,061,175; and 4,064,927). All of these disclosures describe the use of compact patterns (in the form of puck-shaped cylinders). Such patterns and associated gating systems are not distorted under the lost wax method since the wax pattern is applied by dipping a skeletal structure in a molten wax medium and then into a ceramic slurry. The lost wax coatings, when solidified, are stronger than low density polystyrene and the coating configuration is never subjected to surrounding distortion forces once solidified. The ceramic slurry is applied as a light dipped coating in a fluidized condition with little or no forces on the solidified wax coatings. Third, the problem of pattern distorting forces from sand fillings does not appear in the lost wax art.

What is needed is a method and system design that enables distortable patterns to be rigidified in location without an undesirable increase of gating that results in increasing scrap metal.

SUMMARY OF THE INVENTION

A primary object of this invention is to provide an evaporative pattern assembly for metal castings and associated cast metal feeding, the assembly being structurally stable to withstand loose, unbonded sand filling forces when used in ECP and thus promote more dimensionally accurate metal castings.

A first aspect of this invention is the provision of an apparatus consisting of an evaporative pattern assembly for metal castings and associated cast metal feeding, the assembly comprising: (a) a central upright sprue; (b) a plurality of sprue branches integral with and extending radially away from said central sprue at each of at least two axial locations of the central sprue; (c) at least two gating rails, each integrally connected with the extremities of at least two sprue branches extending from different axial locations of the central sprue, each rail being connected to different and independent sprue branches so as to be supported in circumferentially-spaced positions relative to each other about the sprue; and (d) at least one pattern body integrally connected across two of said gating rails. Preferably, the body is complex in configuration having a plurality of projections connected to said rails by gates. Preferably, a plurality of patterns are employed in such an assembly. The radially extending sprue branches are advantageously layered in different planes with the angular spacing between branches being in the range of 45°–90°, the patterns are also advantageously connected across rails of the layered branches so as to promote increased nesting of the patterns within a given flask volume.

Another aspect of this invention is that of the method of making such an evaporative pattern assembly. Such method comprises: (a) molding a first unitary body portion comprised of a central upright sprue and a plurality of sprue branches extending radially away from said central sprue at each of at least two axial locations of the central sprue; (b) molding a plurality of second unitary body portions, each comprised of a casting pattern and a gating rail extending across projections of said casting pattern replica at at least two sides thereof; and (c) bonding one rail of each second body portion to the extremities of at least two sprue branches extending from different axial locations of the central sprue and bonding the other of said rails of each pattern to the extremities of at least two sprue branches at least one of which is independent from that connected to the first rail. Preferably, the extremities of said sprue branches are chamfered so as to present two bonding surfaces for mounting the rails of different and adjacent patterns to the same sprue branch extremity. Preferably, the first unitary body is hollow at least in certain portions thereof. Preferably, the material of which the first and second unitary body portions is comprised of polystyrene having a densitv in the range of 1.2–1.7 lb/ft$^3$, and which material is evaporated at a threshold temperature of 1200° F.

A third aspect of this invention is that of a method of using such a consummable assembly. The method of use particularly comprises: (a) suspending a low density system in a molding flask having an open mouth at its top, the system comprising a central upright sprue, a plurality of sprue branches extending radially away from said central sprue at each of at least two axial locations of the central sprue, at least two gating rails, each integrally connected with the extremities of at least two sprue branches extending from different axial locations of the central sprue, each rail being connected to different and independent sprue branches so as to be supported in radially spaced positions relative to each other, and pattern bodies integrally connected across two of said gating rails; (b) filling said flask, with the low density system suspended therein, by settling loose, unbonded sand about said system, said settling taking place by dropping sand at a plurality of locations from the mouth of said flask causing said sand to rise in said flask along an angle of repose from said points of dropping.

Preferably, the low density system has an evaporative pattern assembly for metal castings and associated cast metal feeding, formed of a common material.

DETAILED DESCRIPTION AND BEST MODE

In ECP, the consummable pattern, gating system and downsprue are made from formed or expanded polystyrene beads. The soft pattern and associated gating and sprue system can distort in the flask during the sand fill and compaction phase of the casting process resulting in defective castings. The severity of this problem varies with the design of the metal casting. For purposes of the preferred embodiment, FIG. 1 partially illustrates the design of a low density system (pattern and metal feeding) which is adapted to result in a plurality of intake manifold castings from a single metal casting pour. These intake manifolds are considered a complex casting in that they do not have a continuous mounting flange on either side of such casting and are particularly vulnerable to distortion of the projecting channels by the sand filling forces. In the design of intake manifolds, care is taken to avoid extra metal bulk therefore causing the design of the walls of much of the casting to be reduced to the thickness only necessary to create a channel. Such wall channels create an intricate geometric body configuration; each project from the main portion of the intake manifold and form cantilevered structures which, when constituted of low density polystyrene foam, can easily be distorted.

Figure 1:
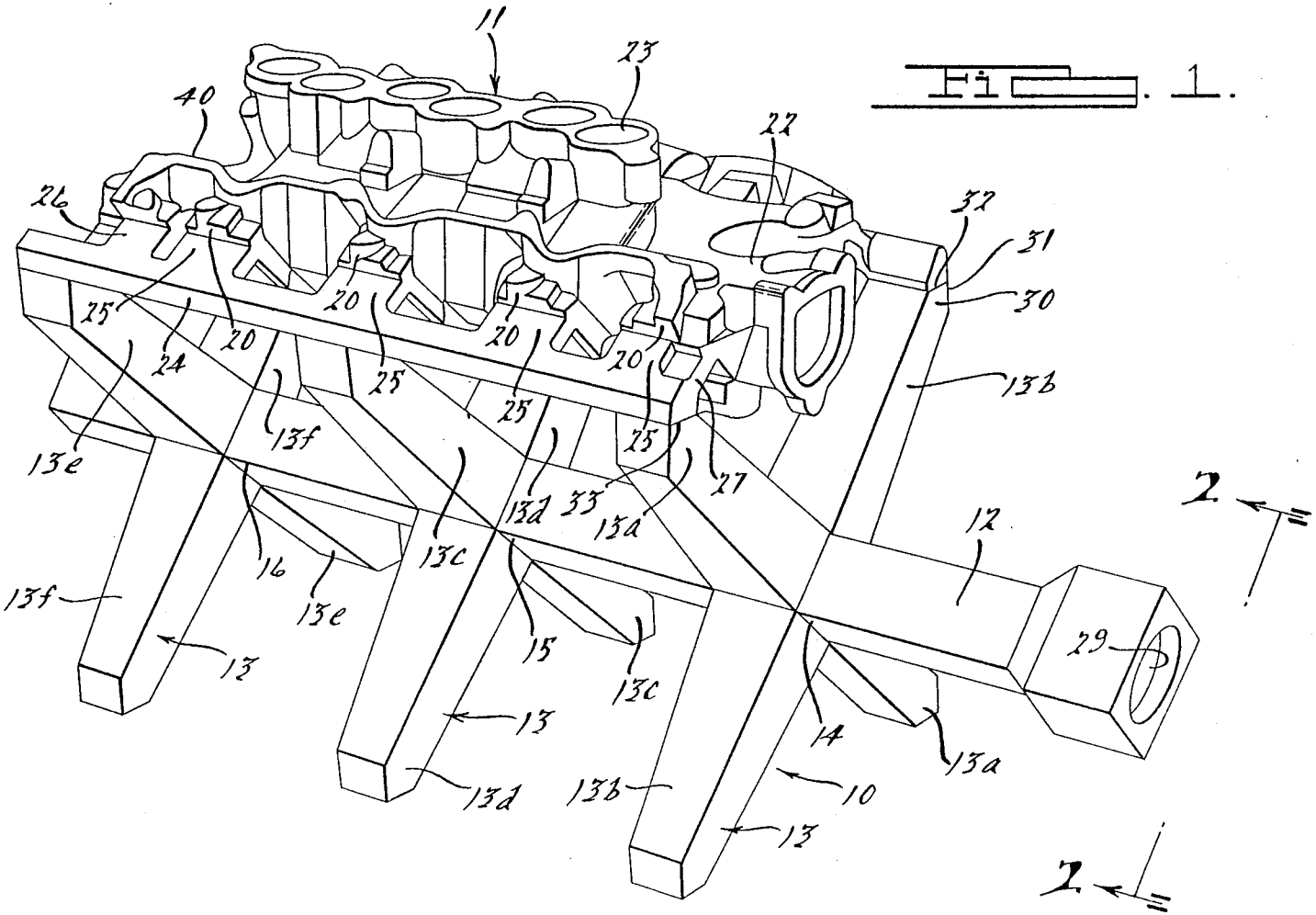
FIG. 1 is a perspective schematic view of one first body portion 10 of the evaporative pattern assembly and one unitary second body portion 11 bonded across the extremities of the branches of the first body portion.

To eliminate such distortion during sand filling in ECP, the low density system is designed as shown in FIG. 1. In this Figure, the assembly is comprised of a first unitary portion 10 having a central upright sprue 12 with a plurality of sprue branches 13 integral with and extending radially away from the central sprue at each of at least two axial locations (14, 15, 16) of said central sprue. To accommodate the proper flow of molten aluminum through the central sprue and sprue branches, the branches are arranged in layers. The first layer has sprue branches **13*a* and 13*b* radiating from the axial location 14, sprue branches 13*c* and 13*d* radiate from a lower axial location 15, and sprue branches 13*e* and 13*f* radiate from a still lower axial location 16. Similar sprue branches radiate at such layered locations but will not be described in more detail since only a minimum of two sprue branches from each axial location are needed to support a single casting pattern or replica 40**. As more casting pattern replicas are utilized in the assembly, similar pairs of sprue branches are needed.

The extremities 30 of each of the sprue branches are chamfered to provide two angled surfaces 31 and 32, only one pair of such surfaces is needed for a particular mounting surface for a pattern replica. The other surface is for an adjacent pattern replica.

The angular spacing 17 between the sprue branches can be in the range of 90°–30°. It is obvious that with 90° branch angular spacing at least four patterns or replicas can be located in a single flask on a single assembly similar to that shown in FIG. 2. If the angular spacing between the sprue branches is decreased to 30°, the number of pattern replicas within a given circumferential arrangement can be increased by a multiple of three to that of 12. Narrower angular spacing between the branches is possible depending upon the configuration of the casting, but it is difficult to conceive that an improvement in casting quality will result by going much below 30°.

The second unitary body portion 11, of which a plurality are employed, are each comprised of a casting pattern 40 which includes a central section 22 which essentially defines any longitudinally extending channels as well as the upright guide ports 23. Extending from a side of the central section, are delivery channels 20 which constitute channels to carry the combustible mixture of air and gasoline to the intake ports of an engine head. A gating rail 24 is integrally defined along such side of the pattern 40 with segments 25 constituting ingates from the rail to each of the delivery channels or portions adjacent thereto. Extra gating segments 26 and 27 may also be employed on each rail to accommodate the proper amount of metal flow that is needed during the casting pour. Each of the rails have a continuous flat surface 33 adapted to mate with the surfaces 31 of the extremities of the sprue branches. A gating rail 28 is integrally defined along the opposite side of the pattern 40, again with segments constituting ingates from rail 28 to similar channels 20.

It is necessary that at least two gating rails (24,28) on each side of a casting pattern or replica be connected with the extremities 30 of at least two sprue branches (**13*a*–13*b*/13*c*–13*d*) extending from two different axial locations 14–15 of the central sprue 12. Each rail 24,28** is connected to different and independent sprue branches so as to be supported in a radially spaced position relative to another rail.

Figure 2:
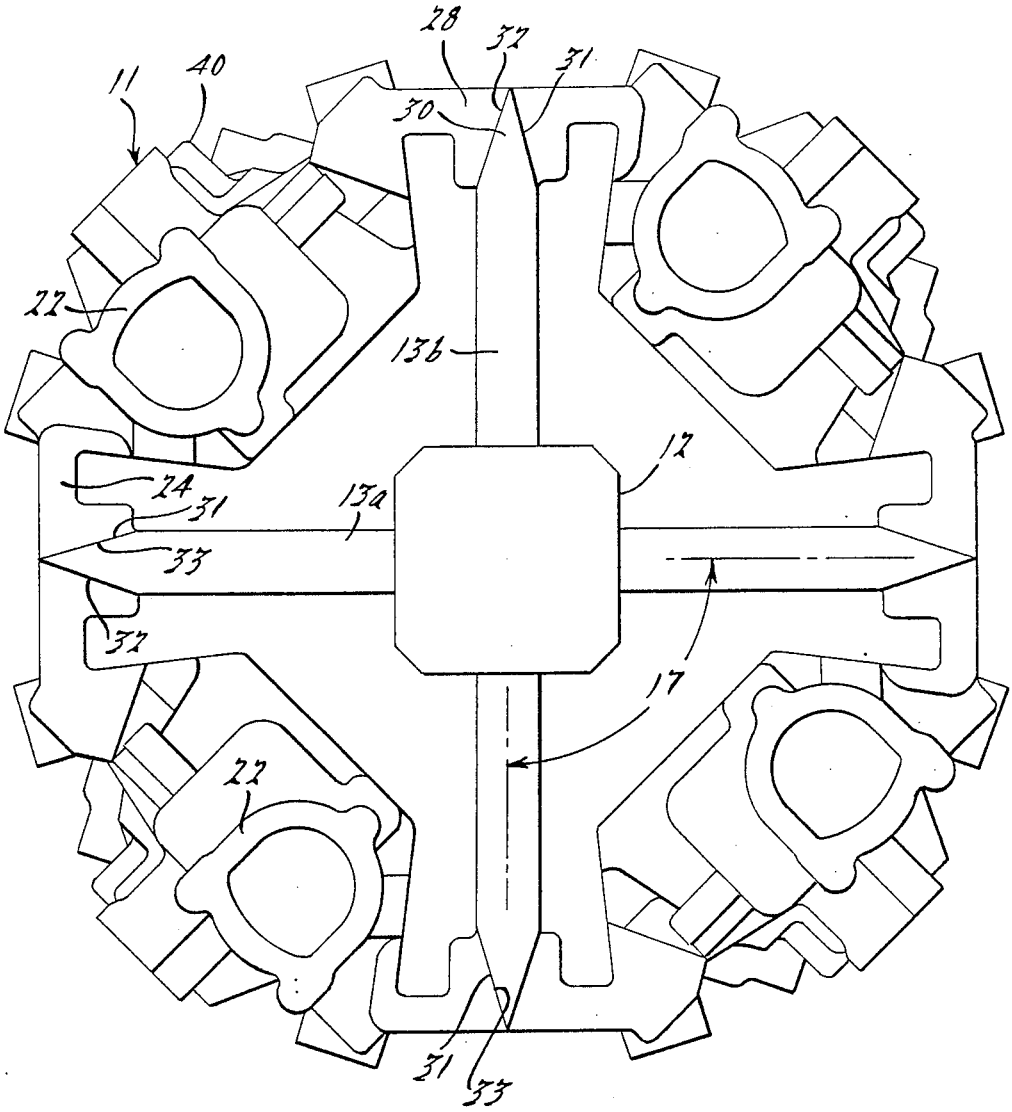
FIG. 2 is a plan view taken substantially along line 2—2 of FIG. 1, but showing how the second body portion is bonded across the branches of the first body portion.

Thus, each casting pattern or replica is integrally connected across two of the gating rails which in turn are connected to a series of sprue branches in radial alignment. The resulting cage-like structure, as shown in FIGS. 1 and 2, facilitates increased rigidity for the distortable, soft pattern material. The sprue 12 and sprue branches 13 may preferably be formed with a hollow configuration 29 (see FIG. 1).

The method of making such evaporative pattern assembly, for metal casting and associated cast metal feeding, comprises: (a) molding the first unitary body portion 10 comprised of a central upright sprue 12 and a plurality of sprue branches 13 which are integral with and extend radially away from the central sprue 12 at each of at least two axial locations of the central sprue 14, 15 or 16; (b) molding a plurality of second unitary body portions 11, each of which are comprised of a casting pattern 40 and at least two gating rails 24,28 each integrally connected across the projections 20 at each side of the casting pattern 40; and (c) bonding one rail 24 of each second body portion 11 to the extremities 30 of at least two sprue branches **13*a*, 13*c* extending from different axial locations 14,15 of the central sprue and bonding the other of said rails 28 of each second unitary body 11 to the extremities 30 of at least two sprue branches 13*b*,13*d***, preferably extending from different axial locations of the central sprue, but angularly spaced from the sprue branches for said one rail.

The sprue branch extremities 30 are chamfered to present surfaces 31–32 for bonding of the surface 33 of each adjacent rail. The material of the first and second unitary body portions is comprised of polystyrene having a density in the range of 1.2–1.7 lb/ft$^3$, and which material evaporates at a temperature of 1200° F. or greater.

Figure 3:
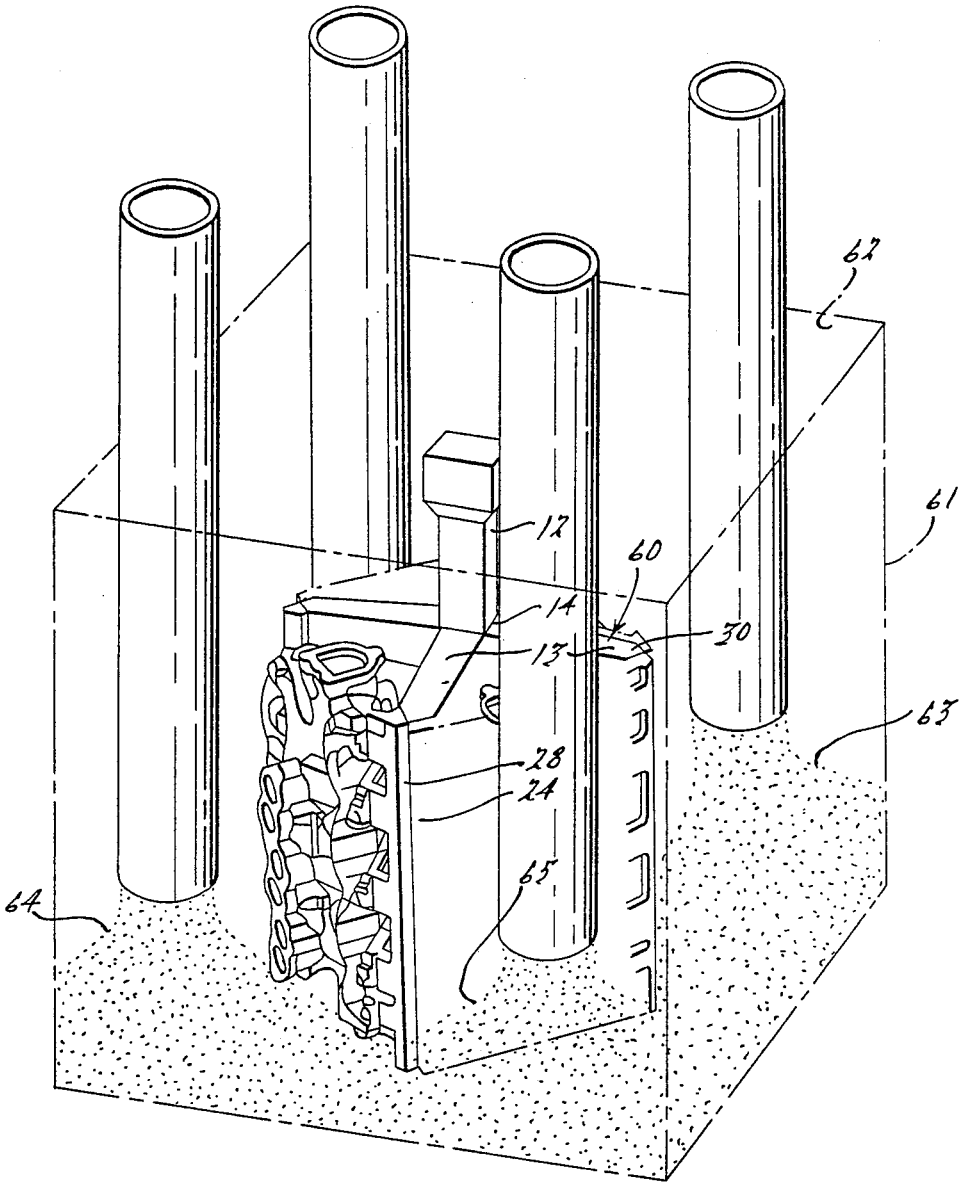
FIG. 3 is a schematic illustration of the low density system suspended during sand filling of a molding flask.

A method of use for such low density system (see FIG. 3) comprises essentially: (a) suspending low density system 60 (an evaporative pattern assembly for metal castings and associated cast metal feeding) in a molding flask 61 having an open mouth 62 at its top, the system comprising a central upright sprue 12, a plurality of sprue branches 13 integral with and extending radially away from the central sprue at each of at least two axial locations 14, 15 or 16 of the central sprue, at least two gating rails 24,28, each integrally connected with the extremities 30 of at least two sprue branches extending from different axial locations of the central sprue, each rail being connected to different and independent sprue branches so as to be supported in radially spaced positions relative to each other, and at least one pattern body 11 integrally connected across two of said gating rails; (b) introducing loose, unbonded free-flowing sand 63 into said flask, about the suspended low density system 60, to build up and settle one or more mounds 64 which may subject the assembly to filling forces as a result of an advancing angle 65 of repose of flowing filling sand.

While particular embodiments of the inventions have been illustrated and described, it will be obvious to those skilled in the art that various changes and modifications may be made without departing from the invention, and it is intended to cover in the appended claims that all such changes and equivalents which fall within the true spirit and scope of the invention.

We claim:

1. An evaporative pattern assembly for metal castings and associated cast metal feeding, comprising:

(a) a central upright sprue;

(b) a plurality of sprue branches integral with and extending radially away from said central sprue at each of at least two axial locations of the central sprue;

(c) at least two gating rails, each integrally connected with the extremities of at least two sprue branche extending from different axial locations of the central sprue, each rail being connected to different and independent sprue branches so as to be supported in circumferentially-spaced positions relative to each other about the sprue; and p1 (d) at least one pattern body integrally connected across two of said gating rails.

2. The assembly as in claim 1, in which a plurality of pattern bodies are attached to said rails.

3. The assembly as in claim 1, in which the radially extending sprue branches are advantageously layered in different planes with the angular spacing between branches being in the range of 30°–90°.

4. The assembly as in claim 3, in which said pattern bodies are connected across rails of said layered branches to promote increased nesting of the pattern bodies within a given volume.

5. A method of making a low density pattern system, comprising:

(a) molding a first unitary body portion comprised of a central upright sprue and a plurality of sprue branches extending radially away from said central sprue at each of at least two axial locations of the central sprue;

(b) molding a plurality of second unitary body portions, each comprised of a casting pattern and a gating rail extending across projections of said casting pattern replica at at least two sides thereof; and (c) bonding one rail of each second body portion to the extremities of at least two sprue branches extending from different axial locations of the central sprue and bonding the other of said rails of each pattern to the extremities of at least two sprue branches, at least one of which is independent from that connected to said first rail.

6. The method as in claim 5, in which the extremities of said sprue branches are chamfered to present two bonding surfaces for mounting the rails of different and adjacent patterns to the same sprue branch extremity.

7. The method as in claim 5, in which said first unitary body is hollow at least in certain portions thereof.

8. The method as in claim 5, in which the material of the first and second unitary body portions is comprised of polystyrene having a density in the range of 1.2–1.7 lb/ft$^3$, and which material is evaporated at a threshold temperature of 1200° F.

9. A method of using a low density pattern system comprising:

(a) suspending a low density system in a molding flask having an open mouth at its top, the system comprising a central upright sprue, a plurality of sprue branches extending radially away from said central sprue at each of at least two axial locations of the central sprue, at least two gating rails, each integrally connected with the extremities of at least two sprue branches extending from different axial locations of the central sprue, each rail being connected to different and independent sprue branches so as to be supported in radially spaced positions relative to each other, and pattern bodies integrally connected across two of said gating rails;

(b) filling said flask, with said low density system suspended therein, by settling loose, unbonded sand about said system, said settling taking place by introducing sand to the interior volume of the flask at one or more locations and causing said sand to rise in said flask along an angle of repose from the point of introduction.

10. The method as in claim 9, in which the low density system is an assembly for metal castings and associated cast metal feeding and is formed of a common material.

* * * * *